US005875517A

United States Patent [19]

Fust

[11] Patent Number: 5,875,517

[45] Date of Patent: Mar. 2, 1999

[54] VACUUM CLEANER AND SUCTION HEAD FOR USE WITH THE VACUUM CLEANER

[76] Inventor: Walter Fust, Quellenrain 34, CH-3063 Ittigen, Switzerland

[21] Appl. No.: 769,306

[22] Filed: Dec. 19, 1996

[30] Foreign Application Priority Data

Dec. 21, 1995 [EP] European Pat. Off. ..... 95810808

[51] Int. Cl.[6] ..... A47L 9/04

[52] U.S. Cl. ..... 15/379; 15/420

[58] Field of Search ..... 15/379, 420

[56] References Cited

U.S. PATENT DOCUMENTS

| | | | |
|---|---|---|---|
| 1,983,566 | 12/1934 | Replogle | 15/379 X |
| 2,072,689 | 3/1937 | Smellie | 15/379 |
| 2,100,089 | 11/1937 | Smellie | 15/379 X |
| 2,120,260 | 6/1938 | Replogle | 15/379 |
| 2,959,805 | 11/1960 | Bodine | 15/379 |
| 3,550,183 | 12/1970 | Wolf | 15/420 X |
| 3,803,658 | 4/1974 | Raubenheimer | 15/379 X |

FOREIGN PATENT DOCUMENTS

| | | |
|---|---|---|
| 556409 | 8/1932 | Germany . |
| L11198 | 5/1954 | Germany . |
| 2212723 | 3/1972 | Germany . |

*Primary Examiner*—Chris K. Moore
*Attorney, Agent, or Firm*—Ostrolenk, Faber, Gerb & Soffen, LLP

[57] ABSTRACT

A vacuum cleaner having a suction head is provided with means which are capable of vibrating the suction head contact surface with respect to the surface to be cleaned. This vibration activates the existing contact surface of the suction head and integrates same into the cleaning process.

7 Claims, 2 Drawing Sheets

VACUUM CLEANER AND SUCTION HEAD FOR USE WITH THE VACUUM CLEANER

BACKGROUND OF THE INVENTION

The present invention relates to a vacuum cleaner comprising a suction head. Furthermore, the invention relates to a vacuum cleaner suction head comprising a driveable unbalanced mass for use with the above defined vacuum cleaner.

During vacuum cleaning, a suction groove provided at the suction head forms, together with the surface to be cleaned, a horizontal suction channel in which a constant air flow or stream having a high air flow rate or speed is generated. This strong air flow loosens the dirt from the surface to be cleaned, and the dirt is then carried away by suction. In the so-called beating vacuum cleaner, a motor driven, rotating beating cylinder is additionally used to loosen the dirt. However, in this case, the suction groove has to be made larger so that the suction channel is enlarged too; this fact reduces the speed of the air flow in this region which causes the cleaning effectiveness to decrease. Additionally, the construction is rather heavy and requires a separate electric connection to the suction head which is undesirable for safety and mobility reasons. In a brush cleaner, rotating brushes are used for loosening the dirt particles. This construction presents roughly the same drawbacks as those of the beating vacuum cleaner.

Furthermore, vacuum cleaners are known where the dirt is loosened from the object to be cleaned by means of vibrating air or high frequency vibrations. These vibrations are generated by means of electromagnetic or piezoelectric vibrators which are expensive, consume much energy and also require an electric connection between the cleaner body and the suction head. In this construction too, broad suction grooves are required.

SUMMARY OF THE INVENTION

The first object of the present invention is to provide a new and useful vacuum cleaner of the kind mentioned above that enables an effective loosening of dirt particles during vacuum cleaning and thus an effective and thorough cleaning. Another object of the invention is to provide such a vacuum cleaner that achieves the intended purposes in a simple and economic way and without need for additional means for contacting the surface to be cleaned.

These objects and still others are achieved by the vacuum cleaner according to the invention which comprises means for vibrating the contact surfaces of the suction head. In this manner, the existing contact surfaces of the suction head are activated and integrated into the cleaning process. The dirt is thus effectively loosened and carried away without requiring expensive and complicated auxiliary means or apparatus. Furthermore, the suction head itself is continuously cleaned by the vibrations.

Further advantageous embodiments will become evident from the following description and the attached claims.

BRIEF DESCRIPTION OF THE DRAWINGS

In the following description, as an exemple, an embodiment of the invention will be explained with reference to the drawing thereof.

DESCRIPTION OF A PREFERRED EMBODIMENT

Figure 1:
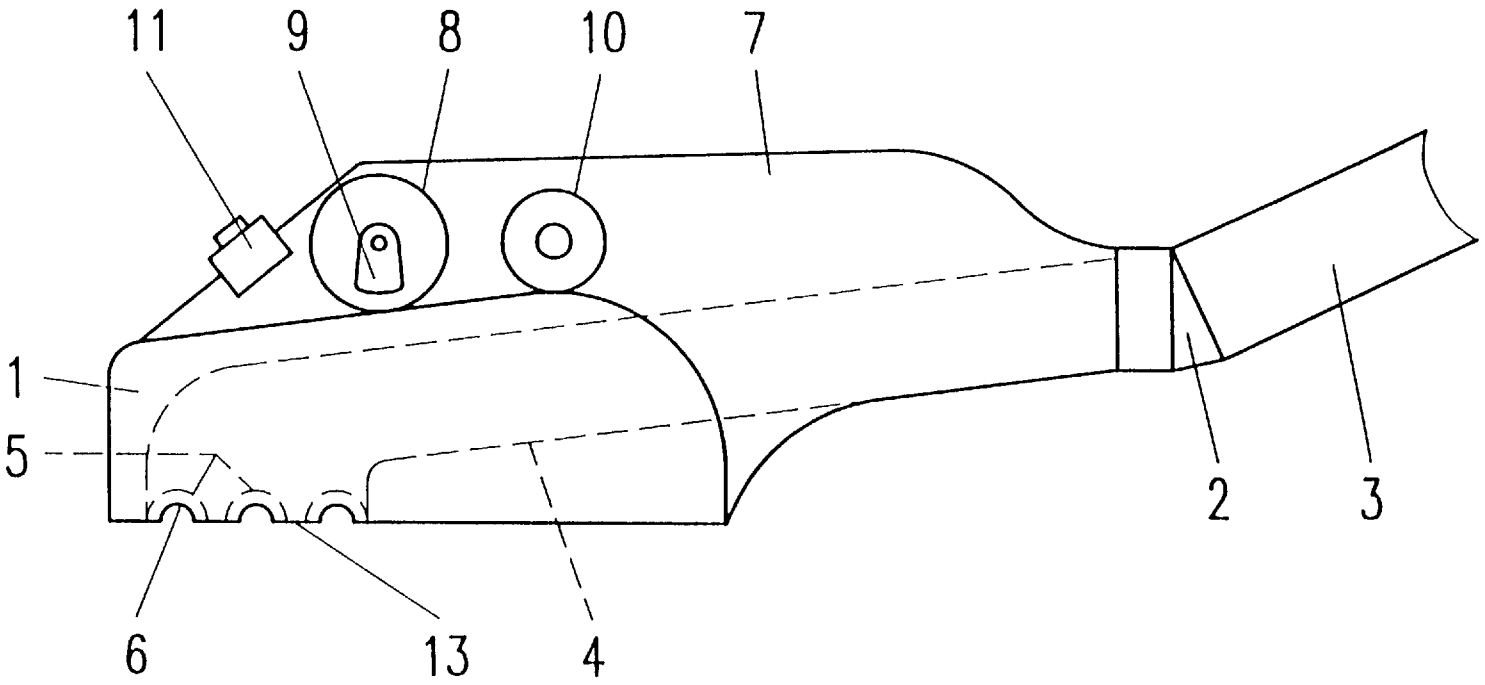
FIG. 1 shows schematically a sectional view of the vacuum cleaner according to the invention.

FIG. 1 shows a schematically represented sectional view of the vacuum cleaner according to the invention. A suction head 1 is connected through an articulated portion 2 to a suction tube 3 which is connected to the motor body of the vacuum cleaner (not shown) in a manner known per se. The suction tube 3 is connected through an intermediary channel 4 within the suction head 1 to a number of narrow suction grooves 5. These suction grooves 5 extend substantially perpendicularly to the plane of the drawing over nearly the whole width of the suction head 1 and form together with the surface to be cleaned during vacuum cleaning a suction channel which is radially closed, the connection to the intermediary channel 4 excepted. A small input opening 6 through which ambient air may enter during vacuum cleaning into the suction channels formed by the suction grooves 5, is provided at the ends of each suction groove 5.

A housing 7 is provided on the suction head 1 in which an electric motor 8 is mounted that can drive at least one unbalanced mass 9 for rotation. The electric motor 8 is powered by an accumulator i.e. a battery 10. This accumulator or battery 10 comprises for example a number of rechargeable nickel cadmium batteries. A slide switch 11 is provided for switching the electric motor 8 on and off. It is also possible to adjust the motor 8 to different motor speeds by selecting different positions of the slide switch 11. The accumulator or battery 10 can be charged through a charge entry 12 (see FIG. 2) by means of a recharge device which is known per se and not shown. The suction head 1 further comprises a contact surface 13 for contacting the surface to be cleaned. The parts 8, 10, 11 and 12 are connected together in a known manner through corresponding connecting leads that are not shown in the Figures.

Figure 2:
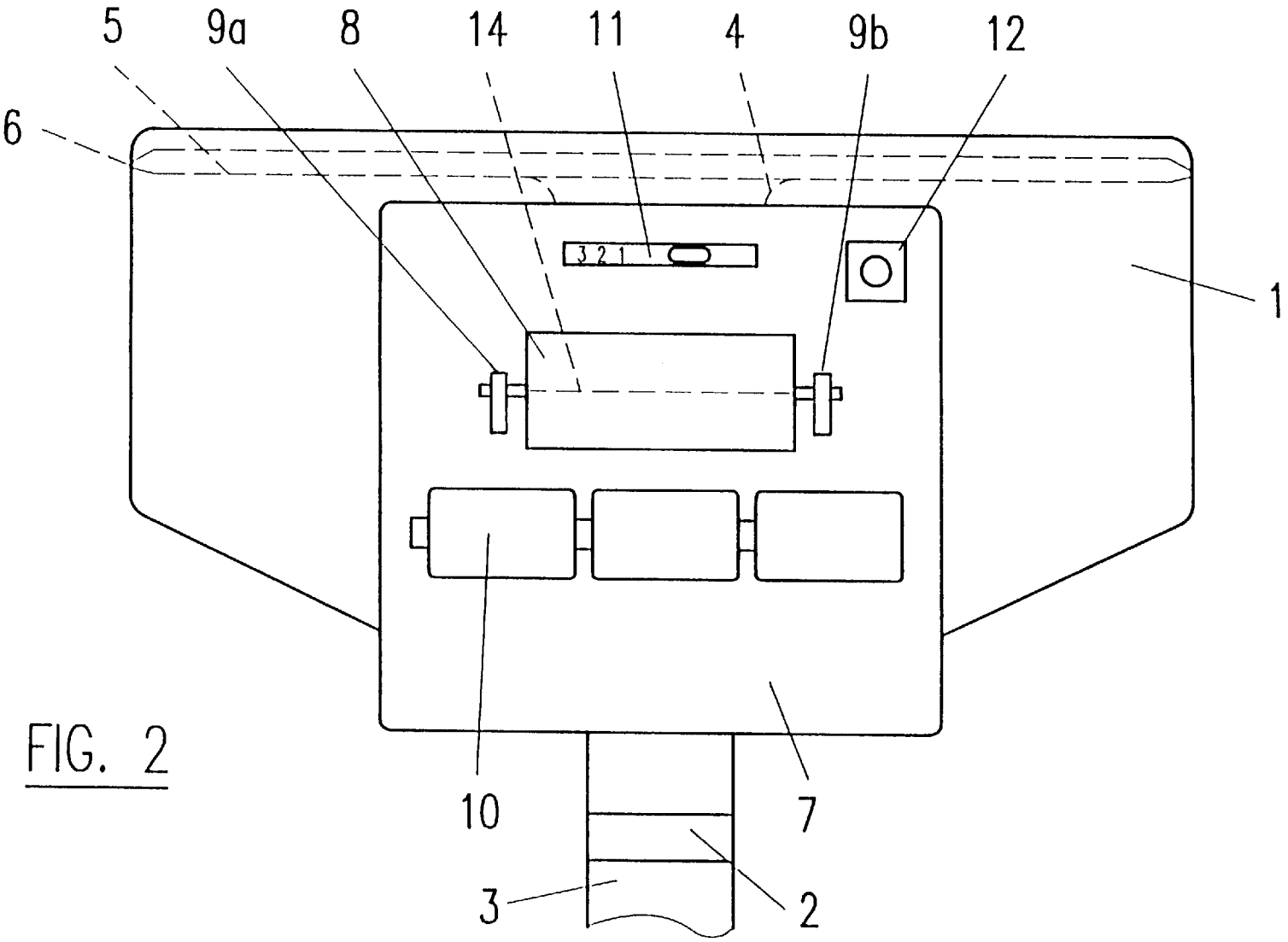
FIG. 2 shows schematically a top view of the vacuum cleaner according to the invention.

FIG. 2 shows in a schematic manner a top view of the vacuum cleaner according to the invention. For sake of clarity, only one suction groove 5 is shown although, of course, two or more parallel suction grooves may be provided. The housing 7 is mounted on the suction head 1 or forms a one-piece part together with the latter. The electric motor 8 is directly fastened to the suction head body. The unbalanced mass 9 comprises two unbalanced weights 9*a* and 9*b* which are symmetrically fastened on both ends of the motor shaft 14. The motor shaft 14 is disposed perpendicularly with respect to the pushing direction of the suction head 1 during vacuum cleaning. This allows for a reduction of the pushing forces.

The vacuum cleaner according to this invention operates in the following manner. For vacuum cleaning, the user switches the electric motor 8 on by moving the switch 11. The motor actuates the unbalanced mass 9 which vibrates the suction head 1. It is important that the contact surface 13 of the suction head 1, i.e. the surface that will be in contact with the object to be cleaned during vacuum cleaning, is made to vibrate. By jolting or shaking the surface to be cleaned, the vibration will loosen dirt particles and this results in a thorough cleaning. The already existent contact surface 13 of the head 1 is thus activated and integrated into the cleaning procedure.

Each fixed suction groove 5 provided in the suction head 1 forms during vacuum cleaning, together with the surface to be cleaned, a narrow, horizontal, radially closed and obstacle free suction channel in which a constant air flow having a high air speed is generated, and this air flow loosens the dirt from the object to be cleaned; the dirt particles are then carried away through the intermediary channel 4 and the suction tube 3. Portions of the fixed edges of the suction groove 5 form a part of the contact surface 13 and can be put into vibration by the unbalanced mass 9. It has turned out that by means of the combination of the narrow, obstacle free suction groove 5 with the vibrating contact surface 13, a particularly good cleaning effect is achieved. The vibrations of the walls of the suction groove 5 move the dirt particles in such a way that they are seized and detached by the strong, unobstructed air stream and carried away.

Of course, other means may be employed for vibrating the contact surface 13 of the suction head 1. The rotatable unbalanced mass 9, however, is an effective, simple and economic solution. It can be placed directly at the suction head 1 so that the whole suction head 1 is vibrated. Advantageously, the unbalanced mass 9 can be rotated by the electric motor 8 which is powered by the rechargeable accumulator 10. In this manner, no electric connection is required coming from the motor body of the vacuum cleaner and leading to the suction head 1.

The suction head 1 comprising the parts 7 to 12 may be mounted afterwards as a supplementary unit for improving the cleaning power and effectiveness on a normal vacuum cleaner.

In a further embodiment (not shown) the suction groove 5 with its contacting surface 13 is not fixedly connected to the suction head 1 but is instead mounted in a vibration damping manner at the suction head 1 i.e. the groove is in an element that is mounted to the suction head in a manner that damps vibration. The unbalanced mass 9 is then disposed in such a manner that it can vibrate the vibration damped suction groove 5. This presents the advantage that not the whole suction head 1 is vibrated so that less energy will be consumed.

What is claimed is:

1. A vacuum cleaner suction head, comprising:

the head having a contact surface contacting a surface to be cleaned, the contact surface having a first dimension in a pushing direction in which the head is moved;

at least one suction groove in the contact surface, the groove having edges perpendicular to the pushing direction and which form part of the contact surface, the at least one groove being shorter in the pushing direction than in a direction perpendicular thereto in the plane of the contact surface; the at least one suction groove opening toward the surface to be cleaned and having an air intake opening at each one of its ends in a longitudinal direction, such that during vacuum cleaning, the at least one groove forms together with the surface to be cleaned a narrow in the pushing direction, obstacle free, high air speed suction channel having a longitudinal axis across the first dimension and which is substantially parallel to the contact surface; and means for vibrating the suction head and thereby for vibrating the contact surface thereof, said means comprising a rotatable unbalanced mass at the suction head and the mass being capable of vibrating the suction head upon rotation of the mass, said unbalanced mass being supported to be rotated around a rotation axis which is substantially parallel to the longitudinal axis of the suction channel.

2. A vacuum cleaner comprising:

(a) a suction head having a contact surface contacting a surface to be cleaned, the contact surface having a first dimension in a pushing direction in which the head is moved;

(b) at least one suction groove in the contact surface, the groove having edges perpendicular to the pushing direction and which form part of the contact surface, the at least one groove being shorter in the pushing direction than in a direction perpendicular thereto in the plane of the contact surface; the at least one suction groove opening toward the surface to be cleaned and having an air intake opening at each one of its ends in a longitudinal direction, such that during vacuum cleaning, the at least one groove forms together with the surface to be cleaned a narrow in the pushing direction, obstacle free, high air speed suction channel having a longitudinal axis across the first dimension and being substantially parallel to the contact surface;

(c) a tube for supplying suction to the at least one groove; and (d) means for vibrating the suction head and thereby for vibrating the contact surface thereof, said means comprising a rotatable unbalanced mass at the suction head and the mass being capable of vibrating the suction head upon rotation of the mass, said unbalanced mass being supported to be rotated around a rotation axis which is substantially parallel to the longitudinal axis of the suction channel.

3. The vacuum cleaner according to claim 2, further comprising an electric motor connected with the unbalanced mass for driving the mass to rotate.

4. The vacuum cleaner according to claim 3, wherein the electric motor is powered by a rechargeable battery.

5. The vacuum cleaner according to claim 3, wherein the electric motor which drives the unbalanced mass is rigidly attached to the suction head.

6. The vacuum cleaner according to claim 2, wherein the unbalanced mass comprises two unbalanced weights fastened on a motor shaft, said motor shaft being mounted essentially perpendicular with respect to the pushing direction of the suction head.

7. The vacuum cleaner according to claim 2, wherein the suction groove is an integral part of the suction.

* * * * *

UNITED STATES PATENT AND TRADEMARK OFFICE

CERTIFICATE OF CORRECTION

PATENT NO. : 5,875,517

DATED : March 2, 1999

INVENTOR(S) : Walter Fust

It is certified that error appears in the above-identified patent and that said Letters Patent is hereby corrected as shown below:

Claim 7, line 2, after "suction" (second occurrence) add -- head --.

Signed and Sealed this

Twenty-sixth Day of October, 1999

*Attest:*

Q. TODD DICKINSON

*Attesting Officer*

*Acting Commissioner of Patents and Trademarks*